US009080375B2

(12) United States Patent
Fleeting

(10) Patent No.: US 9,080,375 B2
(45) Date of Patent: Jul. 14, 2015

(54) STORM WATER ENTRY PREVENTION APPARATUS FOR SLIDING DOOR SYSTEM

(76) Inventor: Robert Fleeting, St. Pete Beach, FL (US)

( * ) Notice: Subject to any disclaimer, the term of this patent is extended or adjusted under 35 U.S.C. 154(b) by 0 days.

(21) Appl. No.: 13/588,953

(22) Filed: Aug. 17, 2012

(65) Prior Publication Data

US 2013/0042535 A1 Feb. 21, 2013

Related U.S. Application Data

(60) Provisional application No. 61/524,598, filed on Aug. 17, 2011.

(51) Int. Cl.
*E04C 2/38* (2006.01)
*E06B 7/26* (2006.01)

(52) U.S. Cl.
CPC ..... *E06B 7/26* (2013.01)

(58) Field of Classification Search
CPC ..... E06B 7/26
USPC ..... 49/404, 460; 52/716.2, 207, 209; 160/43
See application file for complete search history.

(56) References Cited

U.S. PATENT DOCUMENTS

| | | | | |
|---|---|---|---|---|
| 4,208,755 | A * | 6/1980 | Shepherd | 15/160 |
| 5,291,687 | A * | 3/1994 | Abad | 49/404 |
| 5,983,570 | A * | 11/1999 | Brown | 49/475.1 |
| 6,286,263 | B1 * | 9/2001 | Burrill | 49/472 |
| D587,990 | S * | 3/2009 | Fialla-Dori | D8/377 |
| 8,656,979 | B2 * | 2/2014 | Tierney | 160/43 |
| 8,739,469 | B1 * | 6/2014 | Fortun et al. | 49/460 |
| 2002/0194810 | A1 * | 12/2002 | Conachen | 52/718.04 |
| 2003/0024190 | A1 * | 2/2003 | Stanchfield | 52/287.1 |
| 2003/0126826 | A1 * | 7/2003 | Marshall et al. | 52/718.01 |
| 2005/0262772 | A1 * | 12/2005 | Zimmerman | 49/449 |

* cited by examiner

*Primary Examiner* — Jerry Redman

(57) ABSTRACT

A storm water entry prevention apparatus for a sliding door system includes a base, a shield, a wedge, and an adapter. The base connects with the bottom side of the existing door frame from the outside while the shield connects to the base from the top end. The shield is angularly positioned with the existing sliding door so that the water can be easily flow away from the base. When the sliding door is opened or closed, the wedge gently pushes the shield away from the sliding door system. In order to accommodate the screen door, the adapter is connected with the base and the existing door frame.

12 Claims, 17 Drawing Sheets

STORM WATER ENTRY PREVENTION APPARATUS FOR SLIDING DOOR SYSTEM

The current application claims a priority to the U.S. Provisional Patent application Ser. No. 61/524,598 filed on Aug. 17, 2011.

FIELD OF THE INVENTION

The present invention relates generally to an apparatus and method for a weather shield. More specifically, the present invention provides for a weather shield that attaches to a slider door system and prevents water from coming under the doors and a method for installing the weather shield.

BACKGROUND OF THE INVENTION

With normal slider door system, driving rain forces water to push under the slider door in the gap between the bottom of the slider door and the track. When the wind is strong enough, the force with which the rain is pushed through the gap in the interior of the property can cause the water to spray several feet into the air, rapidly causing flooding. It is therefore an object of the present invention to stop wind-driven rain from blowing under the doors or windows. The primary task of the present invention is to help prevent flooding inside the property. The present invention is not designed to stop all water from reaching the door track, as the slider track is designed to handle normal rain conditions. Additional benefits of the present invention are that it also assists in preventing insect migration into the home via the slider door, as well as improve the insulation value of the slider door by providing a barrier to reduce air flow via the slider tracks.

DETAIL DESCRIPTIONS OF THE INVENTION

All illustrations of the drawings are for the purpose of describing selected versions of the present invention and are not intended to limit the scope of the present invention.

Figure 1:
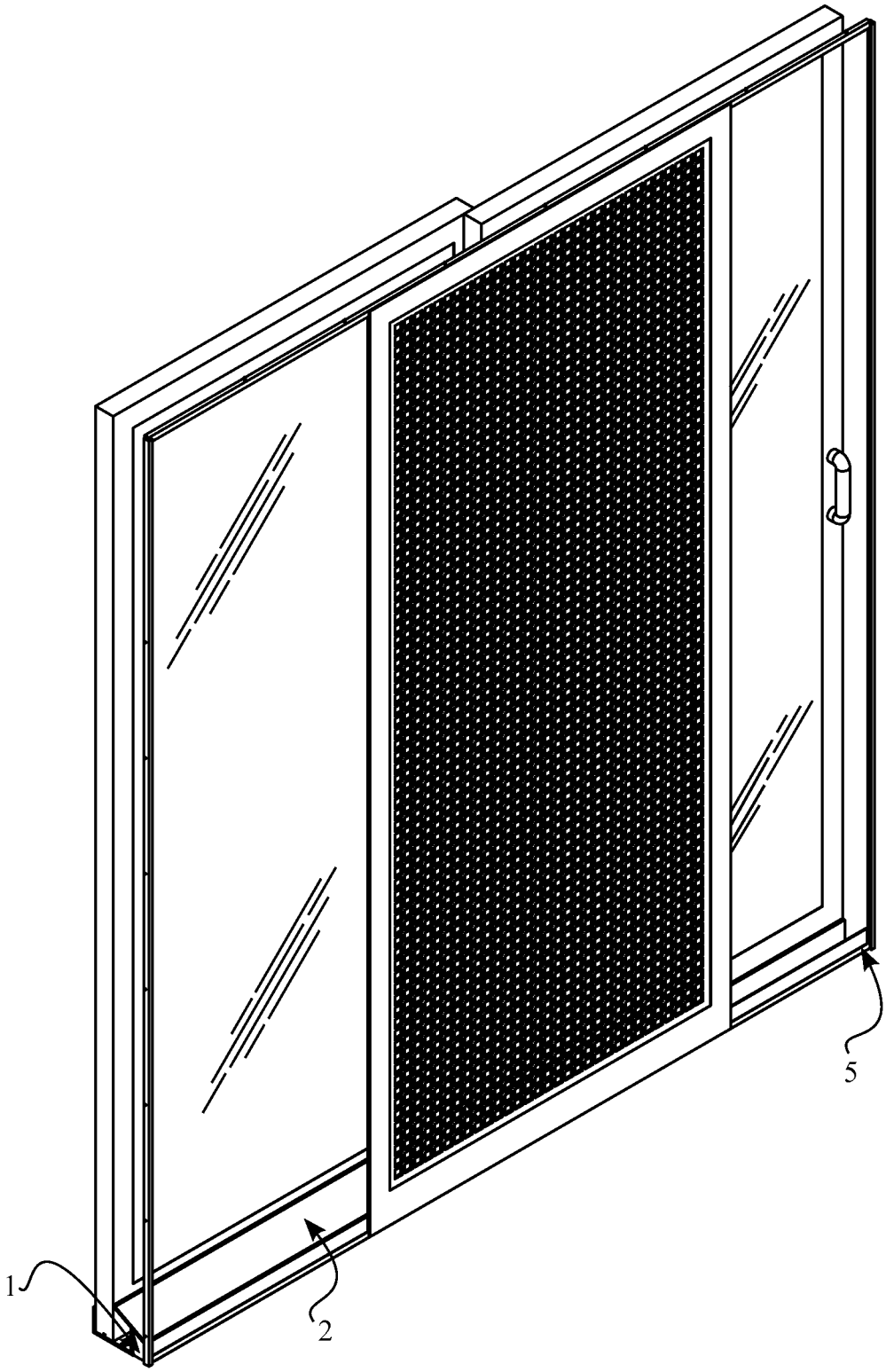
FIG. 1 is a perspective view of a sliding door system with the present invention.
Figure 2:
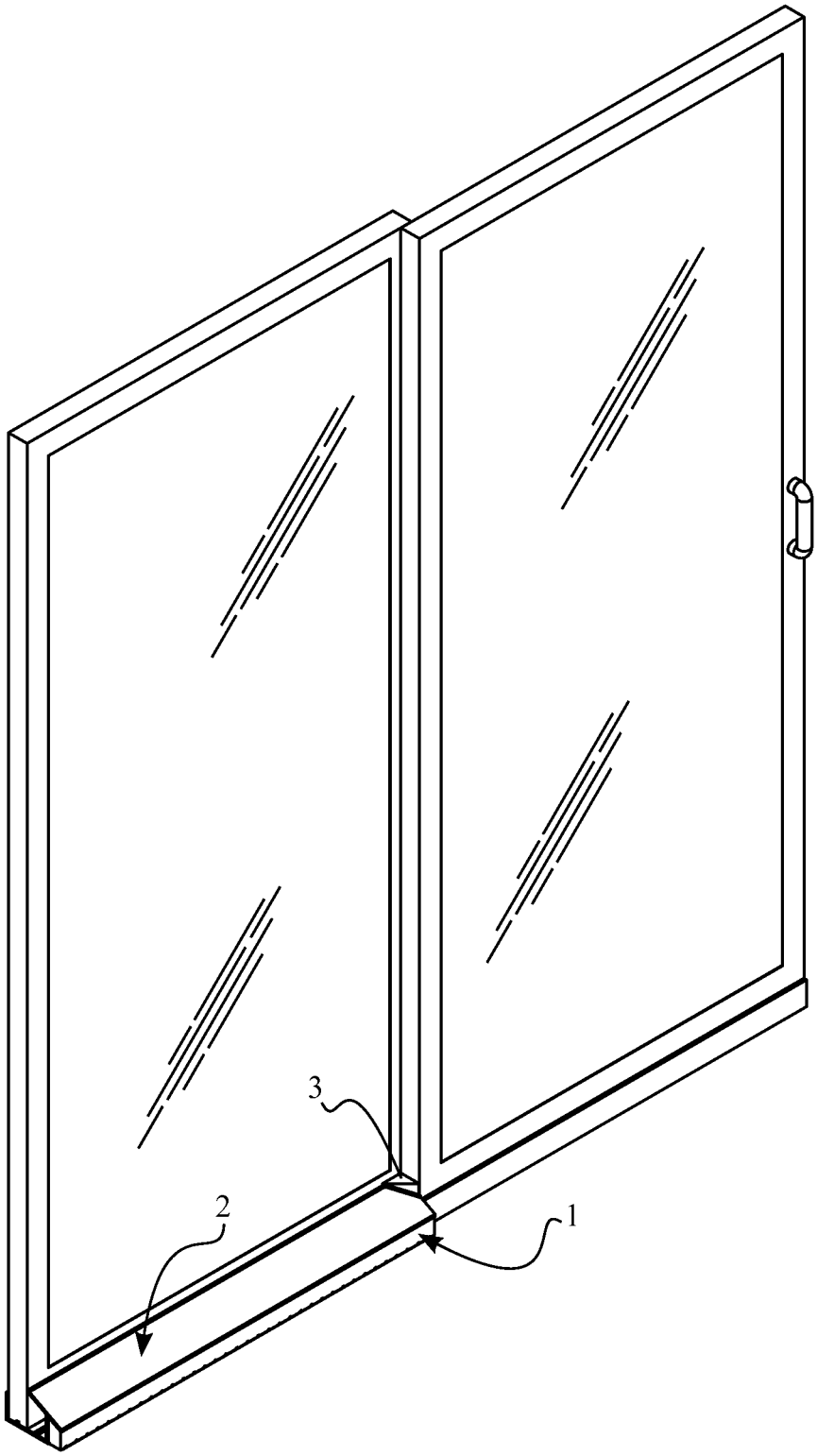
FIG. 2 is a perspective view of the sliding door system with the present invention where an adapter is not shown.

The present invention is a storm water entry prevention apparatus for a sliding door system which prevents water from coming under the sliding door system. Even thought the preferred embodiment is only illustrated the sliding door system, the present invention can also implement into sliding window systems. The present invention is a flexible extruded rubber; composite; or, manmade product that is fitted permanently to the exterior of the sliding doors and windows. The purpose of the present invention is to stop wind-driven rain from blowing under the sliding doors or windows. Even though there are number of different sliding door systems available to consumers, the present invention is designed so that the present invention can be adjusted to accommodate virtually all sliding door system. In reference to FIG. 1, and FIG. 2, the present invention comprises a base 1, a shield 2, a wedge 3, and an adapter 5. The base 1, the shield 2, the wedge 3, and the adapter 5 are compiled into a package, and one package is needed for each sliding door system. The sliding door system comprises a door frame wall, a door track, a slider door, a stationary door, and a screen door. The stationary door is firmly placed within the door track while the slider door and the screen door are movably positioned within the door track. The slider door, the stationary door, and the screen door are connected to the door frame wall where the door frame wall comprises two side walls, a top wall, and a bottom wall.

Figure 3:
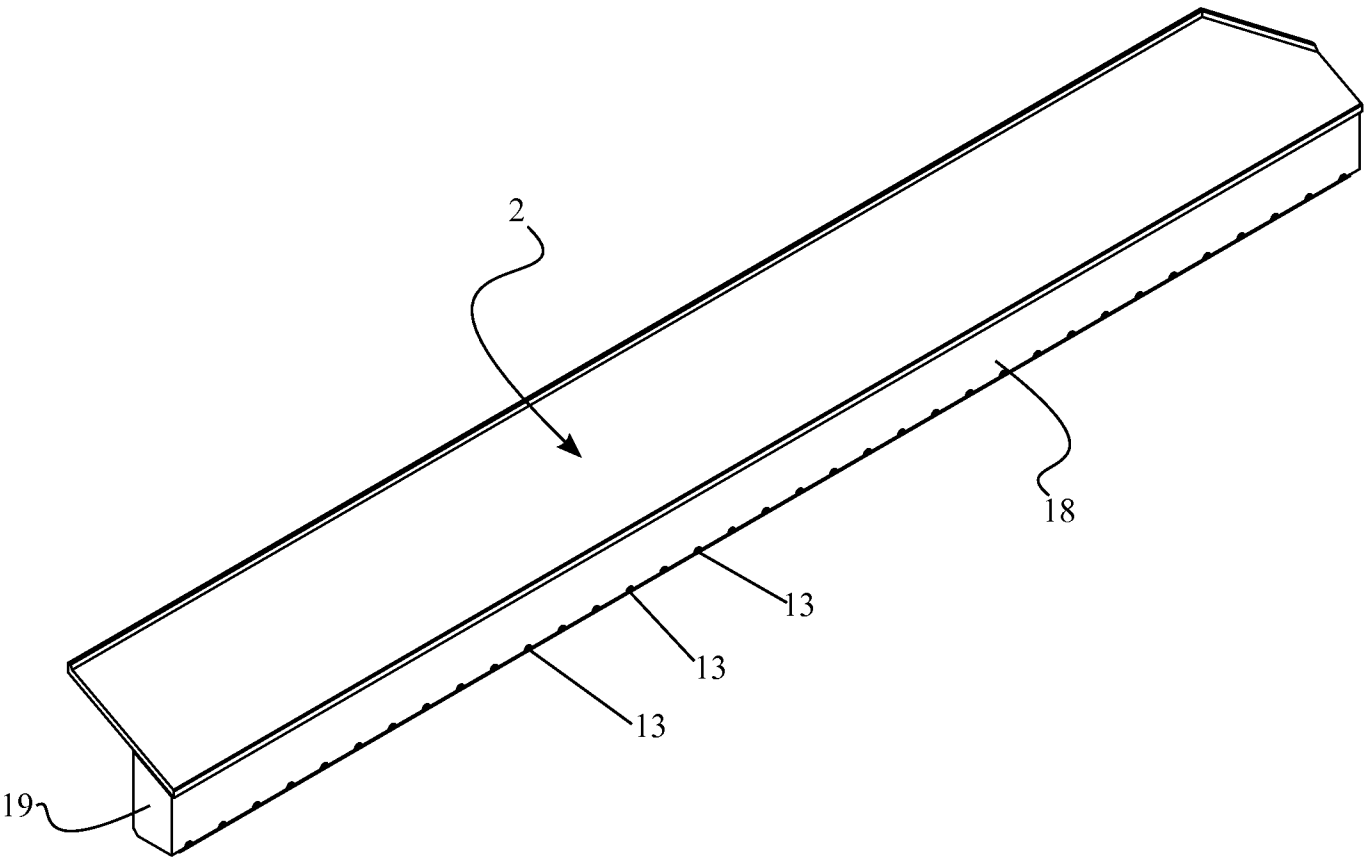
FIG. 3 is a perspective view of a shield and base of the present invention.
Figure 4:
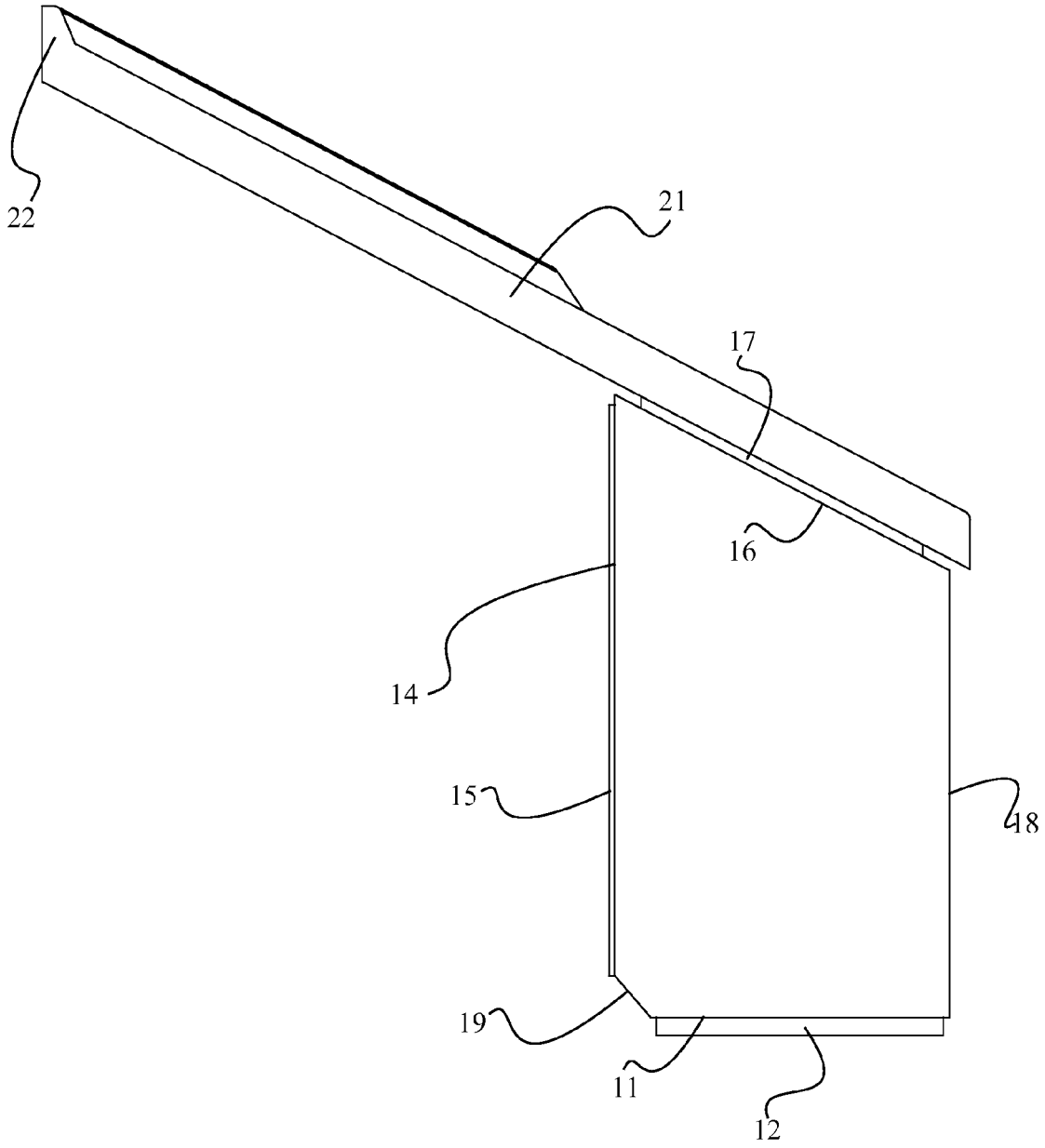
FIG. 4 is a side view of the shield and base in the present invention.

In reference to FIG. 3 and FIG. 4, the base 1 comprises a bottom surface 11, a back surface 14, a top surface 16, a front surface 18, a top adhesive layer 17, and a back channel 19. The front surface 18 and the back surface 14 are oppositely positioned from each other while the top surface 16 and the bottom surface 11 are respectively positioned from the top side and the bottom side. The height of the front surface 18 is smaller than the height of the back surface 14. Due to the height difference between the front surface 18 and the back surface 14, the top surface 16 is positioned as an incline structure. The top adhesive layer 17 is connected to the top surface 16. The back channel 19 is jointly positioned in the edge of the back surface 14 and the bottom surface 11. The back channel 19 is angled to facilitate normal water run-off behind the base 1 so that water does not accumulate within the base 1. The bottom surface 11 comprises a bottom adhesive layer 12 and a plurality of weep channels 13. The bottom adhesive layer 12 is perimetrically connected to the bottom surface 11. The plurality of weep channels 13 is traversed through the back channel 19 and the front surface 18. The plurality of weep channels 13 also removes any accumulating water away from the base 1. The back surface 14 comprises a back adhesive layer 15 where the back adhesive layer 15 is connected with the back surface 14. The base 1 adjacently connects with the bottom wall by the bottom adhesive layer 12 and connects with front side of the door track by the back adhesive layer 15.

In reference to FIG. 4, the shield 2 comprises an incline panel 21 and a sealing panel 22, and the sealing panel 22 is flexibly positioned with the incline panel 21. The incline panel 21 and the sealing panel 22 are constructed into a single component for the proper functionality. The sealing panel 22 and the incline panel 21 are made from high strength flexible materials which uniformly deforms according to the adjacent or supporting surfaces. The incline panel 21 perimetrically connects with the top surface 16 and covers the outside expose area of the door track between the slider door and the side wall. The base 1 establishes a consistent distance between the slider door and the shield 2. The sealing panel 22, where the shield 2 meets the slider door, establishes a good seal between the sealing panel 22 and the exterior of the slider door over the entire width of the slider door when the slider door is closed. However, this seal is necessarily interrupted when opening and closing the slider door. Both top corners of the incline panel 22 are angled according to a path surface 35 of the wedge 3 where the sealing panel is also extended through the both corners of the incline panel 22.

Figure 5:
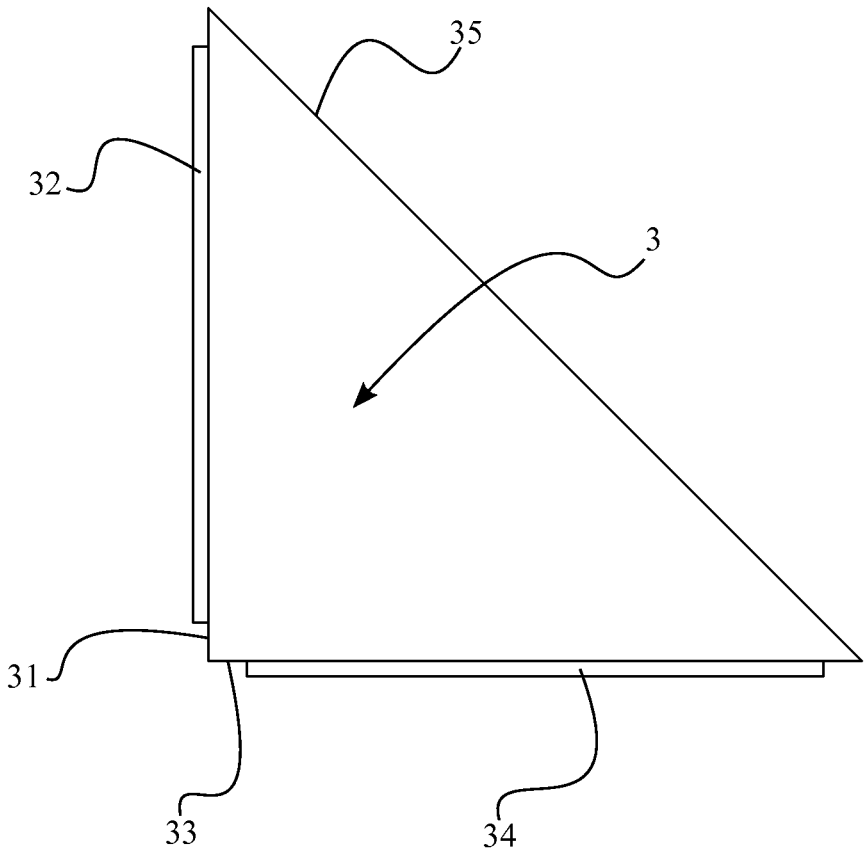
FIG. 5 is a top view of a wedge in the present invention.

The wedge 3 is considered as path redirectors within the present invention since both components provide the same functionality. In reference to FIG. 5, the wedge 3 is shaped into triangular base 1 and comprises a slider door surface 31, a stationary door surface 33, and the path surface 35. The wedge 3 is used to accommodate smaller or larger obstacle difference between the slider door and the stationary door. The wedges 3 are supplied in various sizes and are used to divert the shield 2. Additionally, the wedge 3 can also be cut to suit. The correct size of the wedge 3 is required since the wedge 3 gently pushes out the shield 2 just enough to prevent buckling. The slider door surface 31 is perpendicularly connected with the stationary door surface 33, and the path surface 35 is angularly connected with the slider door surface 31 and the stationary door surface 33. A first adhesive strip 32 is connected with the slider door surface 31, and a second adhesive strip 34 is connected with the stationary door surface 33. The wedge 3 is adjacently located with the base 1 and the shield 2 and connected to the slider door by the first adhesive strip 32 where the second adhesive strip 34 stays parallel with the stationary door. The wedge 3 allows for smooth operation of the slider door as the slider door passes the stationary door.

Figure 11:
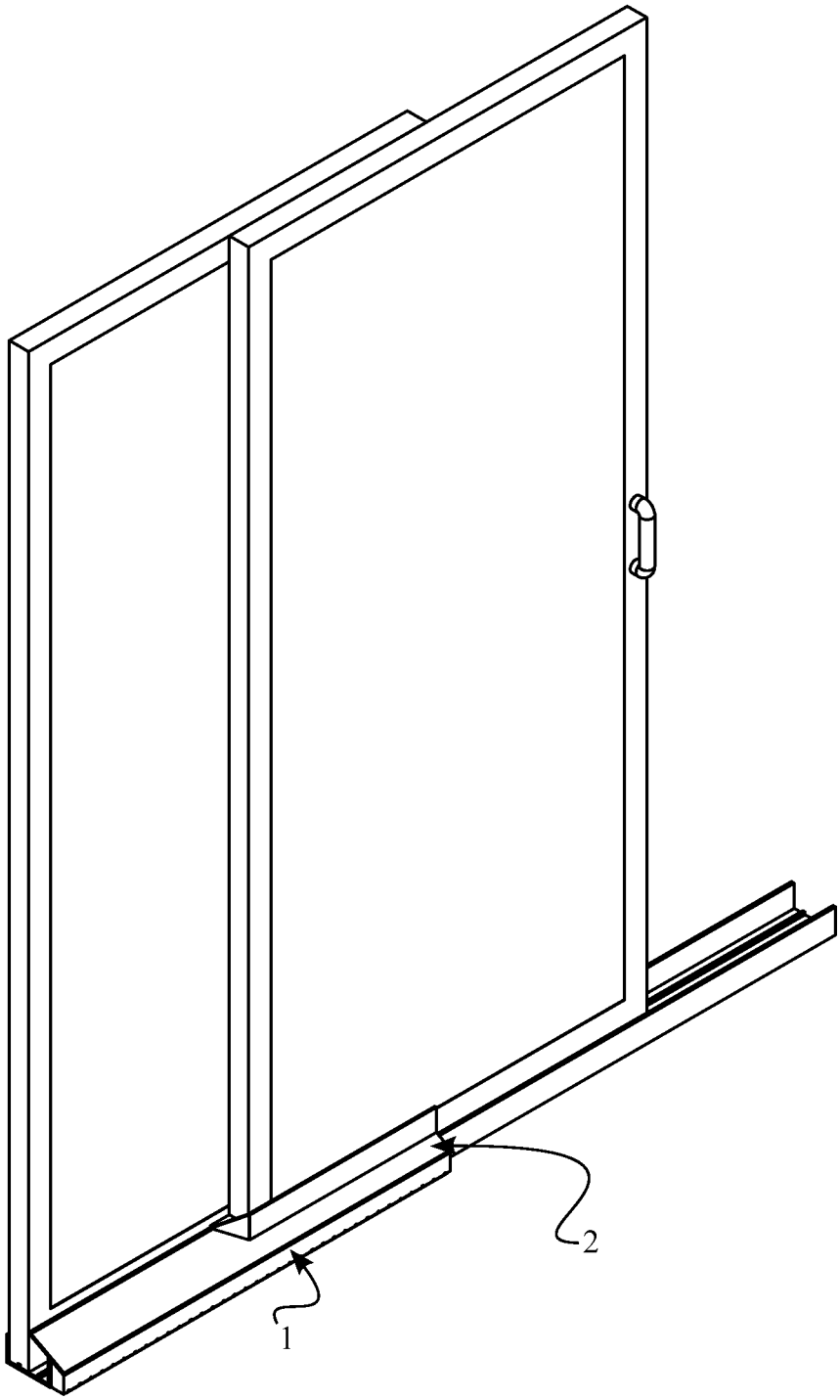
FIG. 11 is a perspective view of the present invention without the adapter where the sliding door system is opened.
Figure 12:
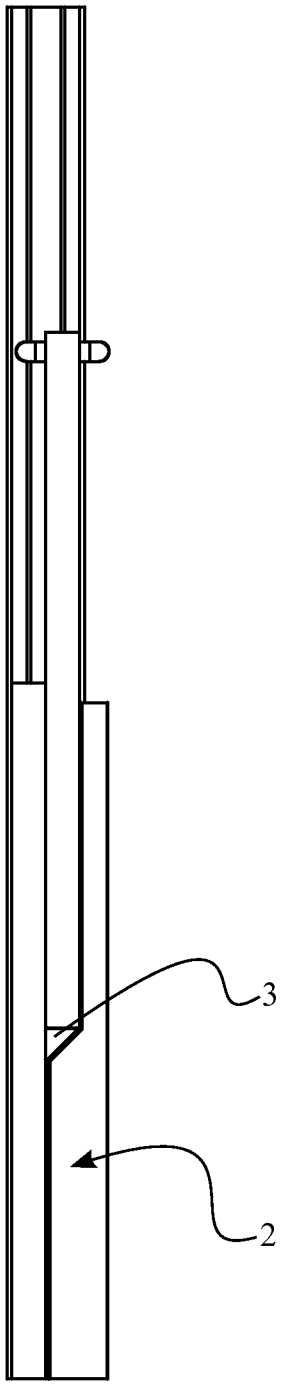
FIG. 12 is a top view of the present invention without the adapter where the sliding door system is opened.

In reference to FIG. 11 and FIG. 12, the wedge 3 ensures that the sealing panel 22 is only minimally displaced as the wedge 3 gently and briefly pushes the sealing panel 22 outward. The contact between the wedge 3 and the sealing panel 22 occurs when opening and closing the slider door. The wedge 3 is crucial components of the present invention as they allow the easy use of the slider door possible. The wedge 3 also serves to minimize the interruption of the established seal when opening and closing the slider door. The displacement of the shield 2 caused by sliding the door is gently moderated by the wedge 3, preventing any buckling or damage to the shield 2. The distance for the displacement is also minimized and restricted to the area of the wedge 3 and to the immediate area adjacent. As such, as the slider door moves toward the side wall, the shield 2 and the sealing panel 22 quickly move back into place; re-establishing the firm seal against the slider door. When the slider door is closed, the sealing panel 22 moves back into its place against the stationary door and the wedge 3.

Figure 6:
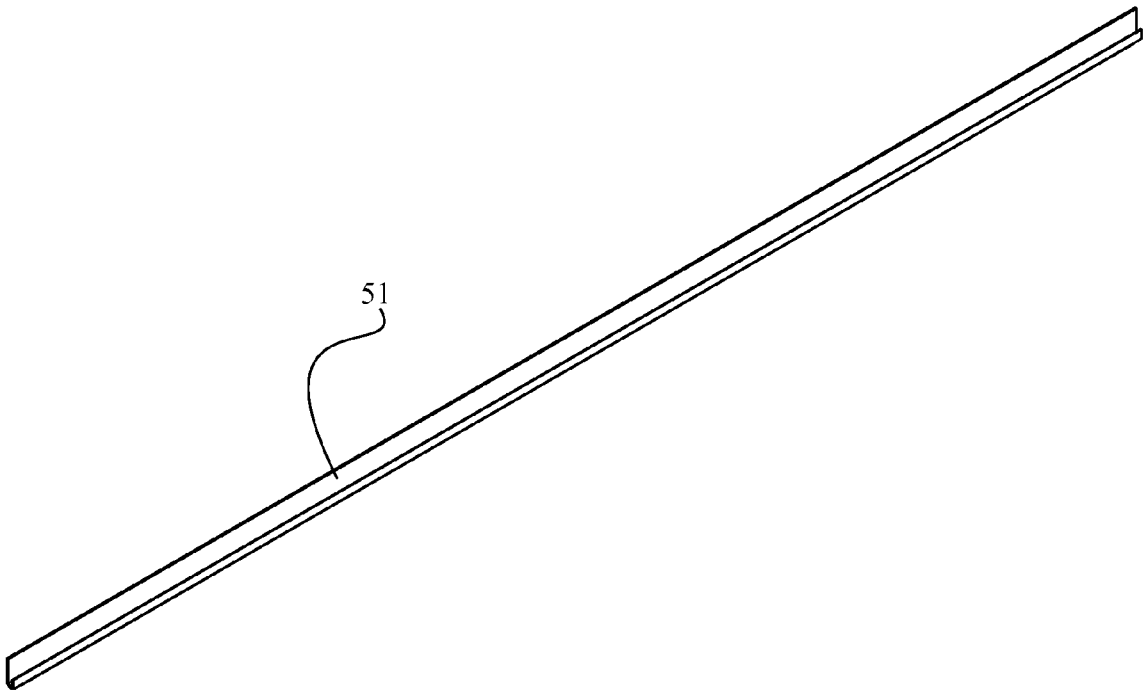
FIG. 6 is a perspective view of a bottom railing in the adapter.
Figure 7:
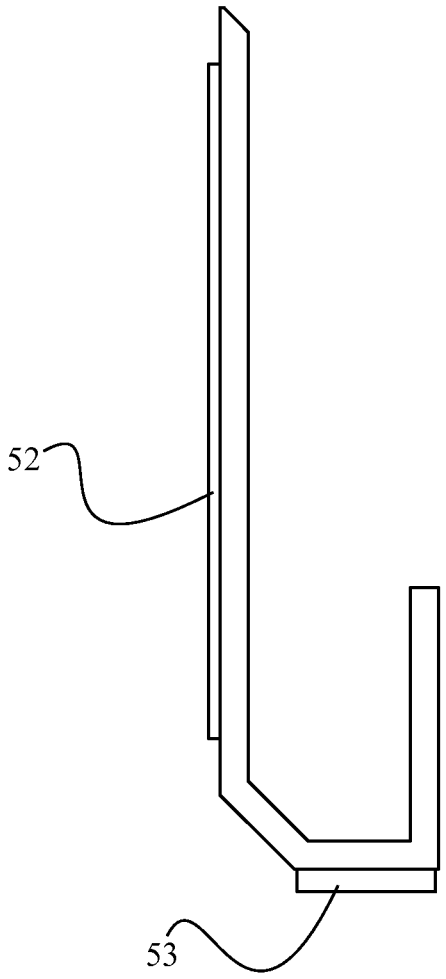
FIG. 7 is a side view of the bottom railing in the present invention.
Figure 8:
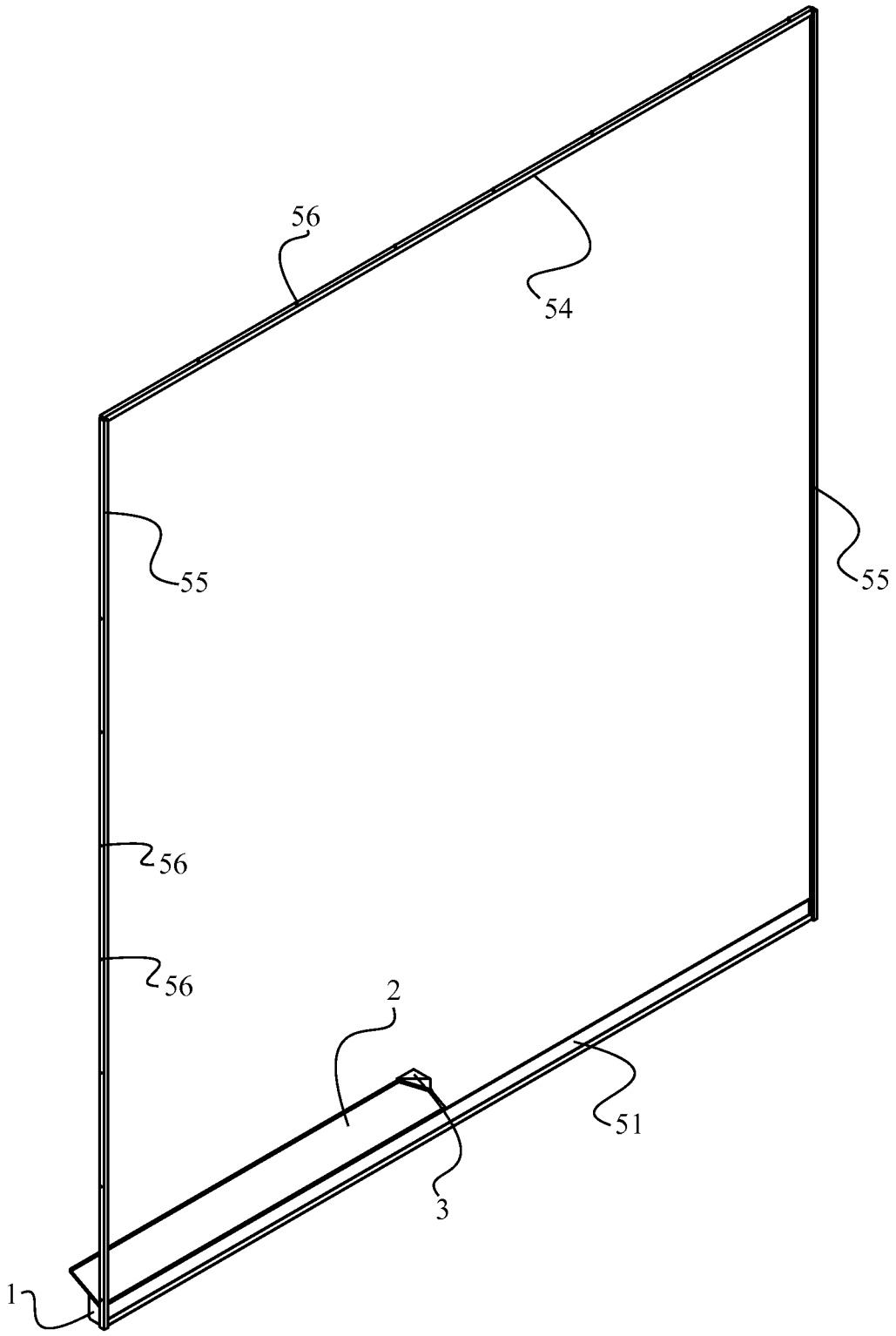
FIG. 8 is a perspective view of the present invention without the sliding door system.
Figure 9:
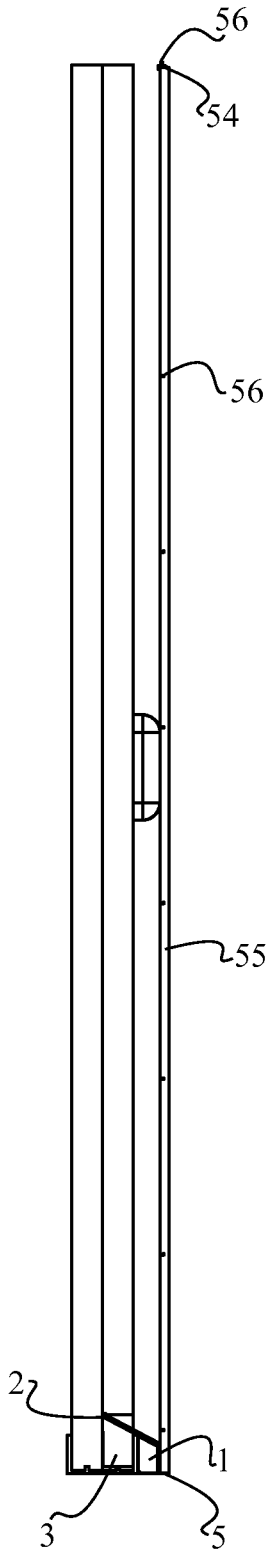
FIG. 9 is a side view of the present invention with the sliding door system.
Figure 10:
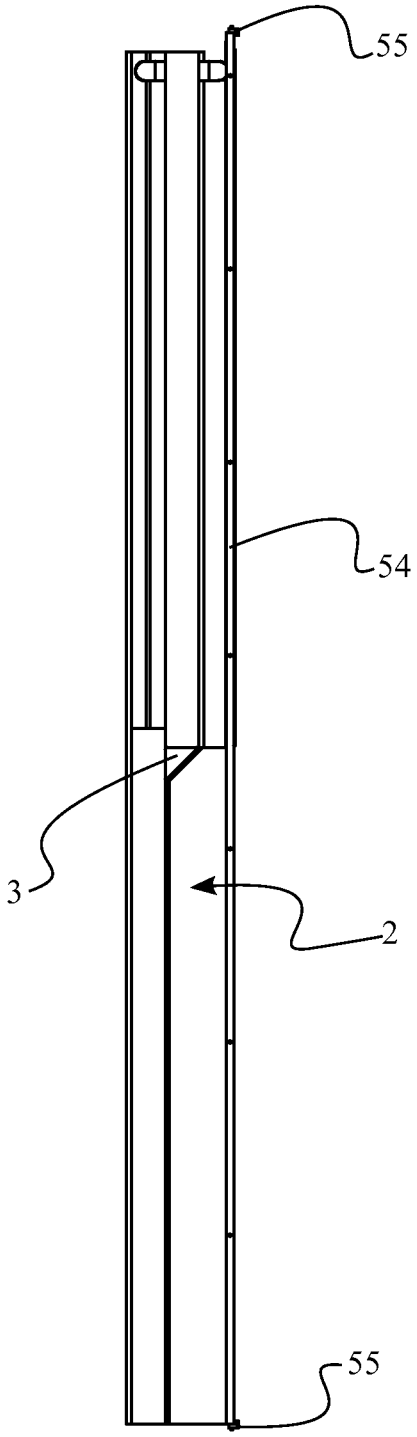
FIG. 10 is a top view of the present invention with the sliding door system.

The adaptor is used during the present invention so that the screen door can be incorporated without further modifications. In reference to FIG. 8, FIG. 9, and FIG. 10, the adaptor comprises a bottom railing 51, a top guide 54, at least two side guides 55, and a plurality of connectors 56. The bottom railing 51 is positioned in front of the front surface 18 and connected to the front surface 18 and the bottom wall. In reference to FIG. 6, the bottom railing 51 comprises a bottom runner, a vertical attachment, and a horizontal attachment. The bottom runner and the vertical attachment are oppositely positioned from each other, and the horizontal attachment connects the bottom runner and the vertical attachment from bottom end creating the U-shape bottom railing 51. The horizontal attachment has protrusions where it makes contact with the bottom wall. The protrusions raise the horizontal attachment so that the rain run-off water can be sufficiently exited. The screen door is positioned on the bottom runner after the adapter is installed. In reference to FIG. 7, the vertical attachment is connected to the front surface 18 by a vertical railing adhesive strip 52, and the horizontal attachment is connected to the bottom wall by a horizontal railing adhesive strip 53. The plurality of connectors 56 may also be used during the connections for additional strength. The top guide 54 is positioned directly above the bottom railing 51 and is connected with the top wall by the plurality of connectors 56. The at least two side guides 55 are perpendicularly positioned with the top guide 54 and the bottom railing 51 and are connected with the two side walls by the plurality of connectors 56.

Figure 13:
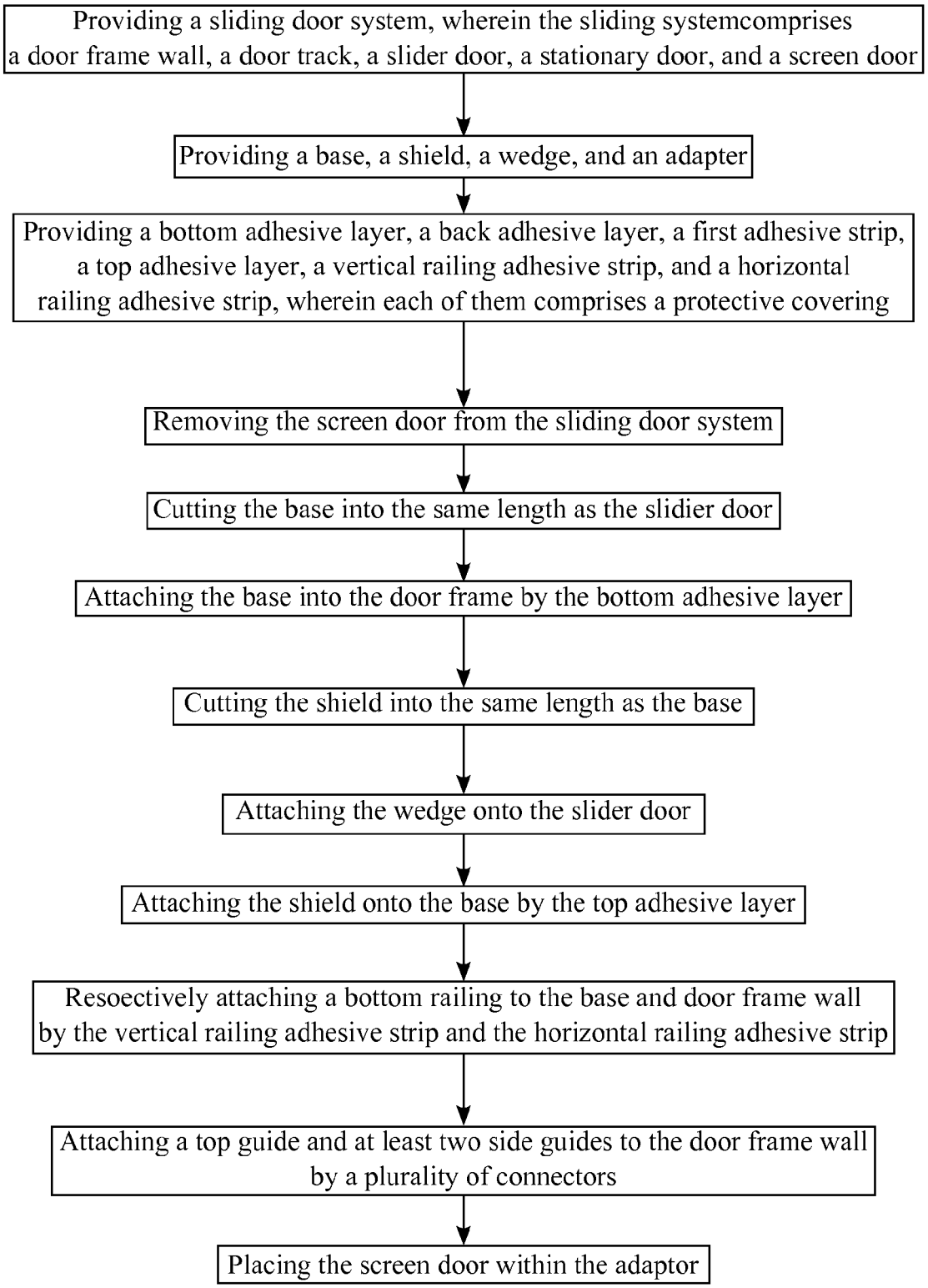
FIG. 13 is a flow chart illustrating the overall installing process of the present invention.
Figure 14:
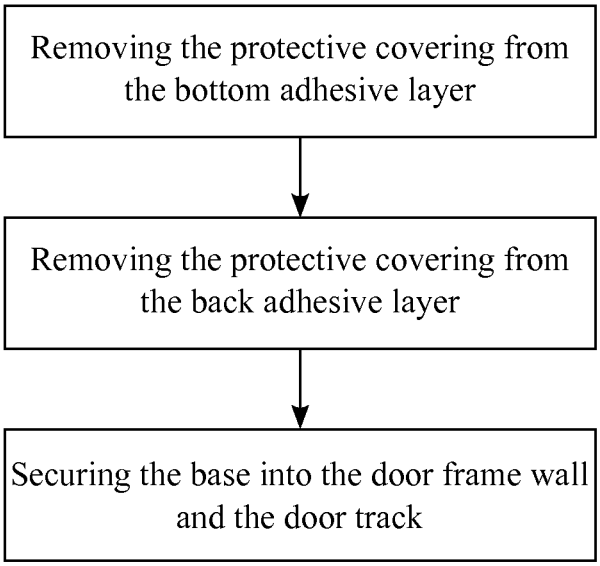
FIG. 14 is a flow chart illustrating the overall process that allows the present invention to install the base.

As for the method of installing the present invention on to the sliding door system, the screen door is removed from the sliding door system. In reference to FIG. 13, the base 1 is then cut into the same length as the slider door, including the frame of the slider door. For the proper functionality of the present invention, the length of the base 1 and the slider door has to be the same size with no overhang. The base 1 can be cut from a cutting device such as a utility knife or a saw. The area of the bottom wall immediately adjacent to the door track and the front side of the door track should be thoroughly cleaned in preparation for adhering of the base 1 to the bottom wall and the front side of the door track. In reference to FIG. 14, once this has been completed, protective coverings on the back adhesive layer 15 and the bottom adhesive layer 12 are respectively removed from the back surface 14 and the bottom surface 11. The base 1 is then carefully lined up to the door track and firmly attached to the bottom wall and to the front side of the door track for the full length of the stationary door. Top end of the back surface 14 should line up approximately with top end of the front side of the door track. If the top of the back surface 14 is too low compare to the top end of the front side of the door track, an expansion piece is installed to the base 1 where the expansion piece increases the height of the base 1.

Then the shield 2 is cut into the same length as the base 1. The corner of the shield 2 must be present where the slider door meets an extension or an adjacent door. During the installation process, one or both of the corners may be cut off and discarded. When cutting the shield 2 to fit the length of the stationary door, depending upon the stationary door configuration, the removal of both corners is appropriate for the slider door as the opening of the slider door does not come into contact with the adjacent door or any other surface that extends. The end of the shield 2 where the corner has been cut off is the end that does not come into contact with the extension or the adjacent door. The length of the stationary door is measured from a tape measure, and the tape measure establishes which end to cut using the cutting device.

After the shield 2 is cut to the length of the base 1, the shield 2 is placed on the base 1 with the sealing panel 22 against the stationary door where the corner comes into contact with the adjacent door or the extension. A height mark is then made on the both stationary and slider door. The height mark should be at the highest point of the shield 2 to facilitate the attachment of the wedge 3.

At some instant, the shield 2 may be wider than required. Then the shield 2 is cut down to an optimal seal width. To establish good contact with the glass panel on the slider door and the sealing panel 22 of the shield 2, the incline panel 21 is marked at both ends where the incline panel 21 meets the top surface 16. A plurality of grooves is cut into the underside of the shield 2 to facilitate cutting the shield 2 to the optimal seal width. Using the plurality of grooves in the underside of the shield 2 and the height mark, the shield 2 is cut ensuring that at the minimum of the incline panel 21 completely comes into contact with the top adhesive layer 17 on the top surface 16 where the optimal seal width is also implemented.

Figure 15:
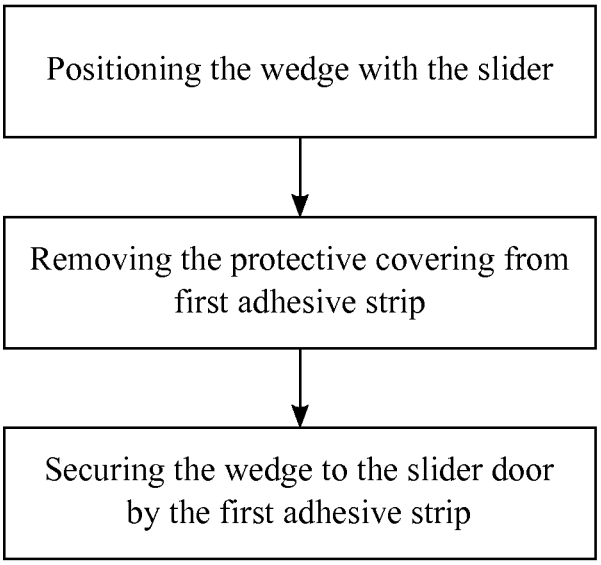
FIG. 15 is a flow chart illustrating the overall process that allows the present invention to install the wedge.

Wherever there is the extension that contacts the shield 2 as the shield 2 opens or closes, there should be the corner and the wedge 3. If the extension accommodates a small or larger obstacle differences, the wedge 3 is used during the installation. In reference to FIG. 15, the protective cover in the first adhesive strip 32 is removed, and the wedge 3 is connected to the slider door. Before peeling away the protective covers on the first adhesive strip 32, the projected adhesive area of the sealing panel 22 or the slider door have to be cleaned and free of debris and dust for proper connection.

Figure 16:
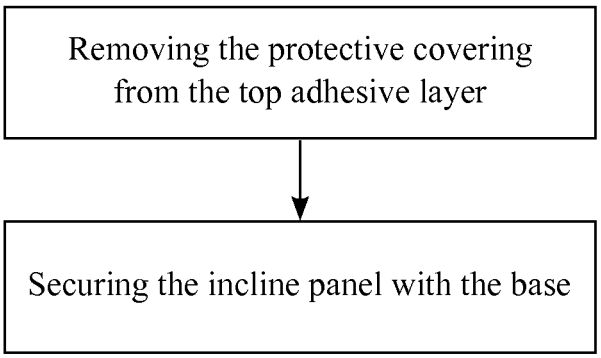
FIG. 16 is a flow chart illustrating the overall process that allows the present invention to install the shield.

In reference to FIG. 16, then the bottom side of the incline panel 21 is attached to the already affixed base 1 by the top adhesive layer 17. Before the attachment, the underside of the incline panel 21 should be prepped for adhering to the base 1 by ensuring that the incline panel 21 is free from dust and debris. Then the protective covering from the top adhesive layer 17 is removed, and the shield 2 is secured to the base 1 by the top adhesive layer 17.

Figure 17:
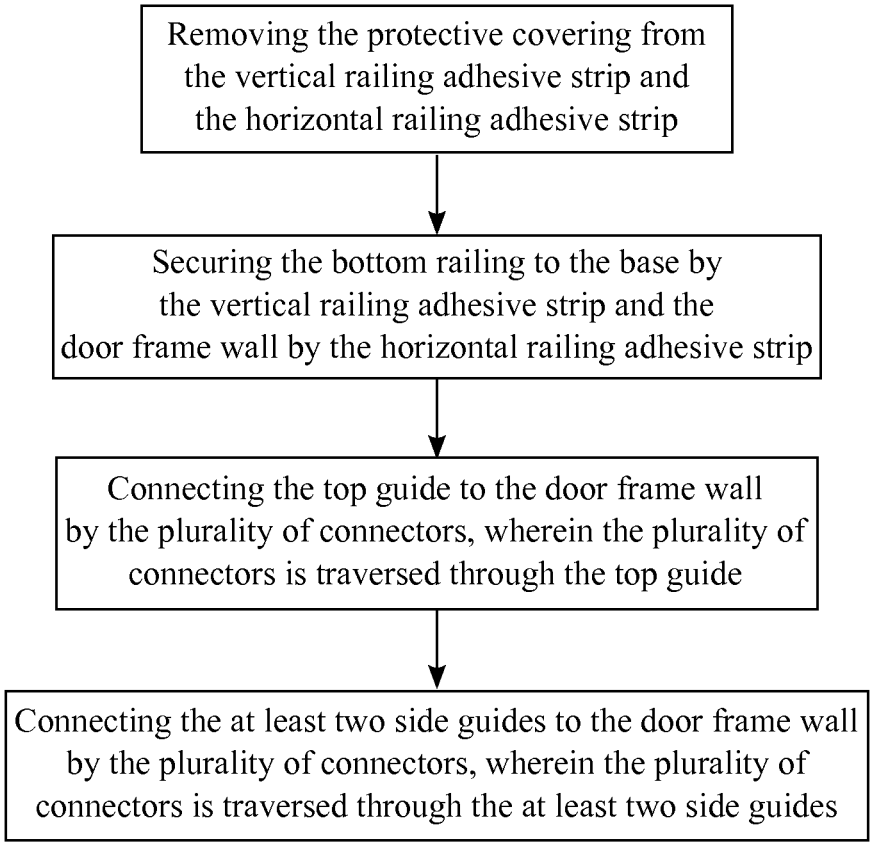
FIG. 17 is a flow chart illustrating the overall process that allows the present invention to install the adapter.

In reference to FIG. 17, the protective coverings from the vertical railing adhesive strip 52 and the horizontal railing adhesive strip 53 are then peeled away so that the bottom railing 51 can be connected to the bottom wall. The plurality of connectors 56 is traversed through the top guide 54 and the at least two side guides 55 so that the screen door can be positioned back with the sliding door system. The present invention can also be constructed according to the standard size window and door so that the installation process can be simplified.

Although the invention has been explained in relation to its preferred embodiment, it is to be understood that many other possible modifications and variations can be made without departing from the spirit and scope of the invention as hereinafter claimed.

What is claimed is:

1. A storm water entry prevention apparatus for a sliding door system comprises,
- a base;
- a shield;
- a wedge;
- an adapter;
- the base comprises a bottom surface, a back surface, a top surface, a front surface, a top adhesive layer, and a back channel;
- the shield comprises an incline panel and a sealing panel;
- the wedge comprises a slider door surface, a stationary door surface, and a path surface;
- the adapter comprises a bottom railing, a top guide, at least two side guides, and a plurality of connectors;
- the base being permanently connected with the shield;
- the wedge being adjacently located with the base and the shield;
- the adapter being connected to the base;
- the bottom railing being adjacently connected with the front surface;
- top guide being located atop the bottom railing;
- the at least two side guides being perpendicularly positioned with the bottom railing and the top guide; and
- the plurality of connectors being inserted through the top guide and the at least two side guides, wherein the plurality of connectors attaches the top guide and the at least two side guides to an existing frame.

2. The storm water entry prevention apparatus for a sliding door system as claimed in claim 1 comprises,
- the front surface and the back surface being oppositely positioned from each other;
- the front surface height being smaller than the back surface height;
- the bottom surface being adjacently positioned below the front surface and the back surface;
- the top surface being angularly connected with the front surface and the back surface; and
- the back channel being jointly positioned with the back surface and the bottom surface.

3. The storm water entry prevention apparatus for a sliding door system as claimed in claim 2 comprises,
- the bottom surface comprises a bottom adhesive layer and a plurality of weep channels;
- the bottom adhesive layer being perimetrically connected to the bottom surface; and
- the plurality of weep channels being traversed through the back channel and the front surface.

4. The storm water entry prevention apparatus for a sliding door system as claimed in claim 2 comprises,
- the back surface comprises a back adhesive layer;
- the back adhesive layer being perimetrically connected to the back surface; and
- the top adhesive layer being perimetrically connected to the top surface.

5. The storm water entry prevention apparatus for a sliding door system as claimed in claim 1 comprises,
- the sealing panel being flexibly positioned with the incline panel; and
- the incline panel being flexibly connected to the top adhesive layer.

6. The storm water entry prevention apparatus for a sliding door system as claimed in claim 1 comprises,
- the slider door surface comprises a first adhesive strip;
- the stationary door surface comprises a second adhesive strip;
- the slider door surface being perpendicularly positioned with the stationary door surface;
- the path surface being angularly positioned in between the slider door surface and the stationary door surface;
- the first adhesive strip being connected to the slider door surface; and
- the second adhesive strip being connected to the stationary door surface.

7. The storm water entry prevention apparatus for a sliding door system as claimed in claim 1 comprises,
- the slider door surface being perpendicularly located with the back surface; and
- the stationary door surface being adjacently positioned with the sealing panel.

8. A storm water entry prevention apparatus for a sliding door system comprises,
- a base;
- a shield;
- a wedge;
- an adapter;
- the base comprises a bottom surface, a back surface, a top surface, a front surface, a top adhesive layer, and a back channel;
- the shield comprises an incline panel and a sealing panel;
- the wedge comprises a slider door surface, a stationary door surface, and a path surface;

the adapter comprises a bottom railing, a top guide, at least two side guides, and a plurality of connectors;

the sealing panel being flexibly positioned with the incline panel;

the incline panel being flexibly connected to base by the top adhesive layer;

the wedge being adjacently located with the base and the shield;

the adapter being connected to the base;

the bottom railing being adjacently connected with the front surface;

top guide being located atop the bottom railing;

the at least two side guides being perpendicularly positioned with the bottom railing and the top guide; and the plurality of connectors being inserted through the top guide and the at least two side guides, wherein the plurality of connectors attaches the top guide and the at least two side guides to an existing frame.

9. The storm water entry prevention apparatus for a sliding door system as claimed in claim 8 comprises, the front surface and the back surface being oppositely positioned from each other;

the front surface height being smaller than the back surface height;

the bottom surface being adjacently positioned below the front surface and the back surface;

the top surface being angularly connected with the front surface and the back surface; and the back channel being jointly positioned with the back surface and the bottom surface.

10. The storm water entry prevention apparatus for a sliding door system as claimed in claim 9 comprises, the bottom surface comprises a bottom adhesive layer and a plurality of weep channels;

the bottom adhesive layer being perimetrically connected to the bottom surface; and the plurality of weep channels being traversed through the back channel and the front surface.

11. The storm water entry prevention apparatus for a sliding door system as claimed in claim 9 comprises, the back surface comprises a back adhesive layer;

the back adhesive layer being perimetrically connected to the back surface; and the top adhesive layer being perimetrically connected to the top surface.

12. The storm water entry prevention apparatus for a sliding door system as claimed in claim 8 comprises, the slider door surface comprises a first adhesive strip;

the stationary door surface comprises a second adhesive strip;

the slider door surface being perpendicularly positioned with the stationary door surface;

the slider door surface being perpendicularly located with the back surface;

the stationary door surface being adjacently positioned with the sealing panel;

the path surface being angularly positioned in between the slider door surface and the stationary door surface;

the first adhesive strip being connected to the slider door surface; and the second adhesive strip being connected to the stationary door surface.

* * * * *